US009802415B2

(12) United States Patent
Driessen-Olde Scheper et al.

(10) Patent No.: US 9,802,415 B2
(45) **Date of Patent: *Oct. 31, 2017**

(54) INK STORAGE APPARATUS HAVING AN AGITATOR FOR A PRINTING SYSTEM

(71) Applicant: OCÉ-TECHNOLOGIES B.V., Venlo (NL)

(72) Inventors: Lamberdina J. A. M. Driessen-Olde Scheper, Venlo (NL); Johannes H. L. Smeyers, Venlo (NL)

(73) Assignee: OCÉ-TECHNOLOGIES B.V., Venlo (NL)

( * ) Notice: Subject to any disclaimer, the term of this patent is extended or adjusted under 35 U.S.C. 154(b) by 0 days.

This patent is subject to a terminal disclaimer.

(21) Appl. No.: 15/282,455

(22) Filed: Sep. 30, 2016

(65) Prior Publication Data

US 2017/0096009 A1 Apr. 6, 2017

(30) Foreign Application Priority Data

Oct. 2, 2015 (EP) ..... 15188138

(51) Int. Cl.
*B41J 2/175* (2006.01)

(52) U.S. Cl.
CPC ..... *B41J 2/17513* (2013.01)

(58) Field of Classification Search
CPC ..... B41J 2/17513
See application file for complete search history.

(56) References Cited

U.S. PATENT DOCUMENTS

| | | | |
|---|---|---|---|
| 9,109,316 | B1 | 8/2015 | Thomson |
| 2007/0030322 | A1 | 2/2007 | Lee et al. |
| 2009/0038347 | A1 | 2/2009 | Finch et al. |
| 2010/0103233 | A1 | 4/2010 | Akatsuka et al. |
| 2012/0026258 | A1 | 2/2012 | Leighton et al. |
| 2015/0053033 | A1 | 2/2015 | Niederstadt et al. |

FOREIGN PATENT DOCUMENTS

| | | | |
|---|---|---|---|
| CA | 2 762 040 | A1 | 6/2013 |
| EP | 1 764 223 | A2 | 3/2007 |
| EP | 2 489 516 | A1 | 8/2012 |
| JP | 60110458 | * | 6/1985 |

* cited by examiner

*Primary Examiner* — Juanita D Jackson
(74) *Attorney, Agent, or Firm* — Birch, Stewart, Kolasch & Birch, LLP

(57) ABSTRACT

An ink storage apparatus and an agitator device in a printing system having at least one agitator member rotatable about an axis, wherein the agitator member includes a plurality of fin elements that extend out of a primary plane of the agitator member. The agitator member includes a paddle element having a generally planar rectangular configuration, and a plurality of fin elements that extend out of a plane of the paddle element. The ink storage apparatus has at least one ink container defining a storage volume for holding a predetermined volume of printing ink, and the agitator device is arranged within the storage volume of the ink container for agitating the ink.

18 Claims, 2 Drawing Sheets

INK STORAGE APPARATUS HAVING AN AGITATOR FOR A PRINTING SYSTEM

CROSS-REFERENCE TO RELATED APPLICATIONS

This application claims priority under 35 U.S.C. §119(a) to Application No. 15188138.0, filed in Europe on Oct. 2, 2015, the entire contents of which is hereby incorporated by reference into the present application.

BACKGROUND OF THE PRESENT INVENTION

1. Field of the Invention

The present invention relates to an ink storage apparatus for a printing system and to a printing system that includes such an ink storage apparatus.

In large-scale printing systems, printing ink is typically stored in a reservoir or ink supply comprising one or more bottles. During extended periods of stand-by or non-use of the printing system, such as over-night, weekends, or holiday periods, the ink may begin to separate into different component parts. In this regard, printing inks can be complex compositions, and may include a dispersion of solid particles in a liquid mix comprising, for example, wax and/or a gelling agent. Separation of the components is problematic because it naturally has a direct impact upon the print quality.

For this reason, ink storage assemblies for printing systems have been developed, which include mixing devices in the reservoir or ink supply to prevent separation of the ink into its different components, and to maintain the ink in a well-mixed state. In this context, however, it has been found that known ink storage arrangements are sub-optimal in the efficiency and effectiveness of the mixing of the ink they hold. In particular, it will be appreciated that the ink held in the reservoir or ink supply should be mixed uniformly. This is not only critical to providing a fast start-up time for the printing system after a stand-by period or non-use period, but also for ensuring good print quality on the first and following printed media.

SUMMARY OF THE INVENTION

In view of the above, an object of the present invention is to provide a new ink storage apparatus designed for improved mixing of printing ink held in the storage apparatus, and a printing system which includes such an ink storage apparatus. In this regard, it would be particularly desirable to provide an ink storage apparatus which provides for a relatively quick and complete mixing of the ink with relatively low energy consumption, for example, via a low mixing speed. Further, it would be desirable to provide an ink storage apparatus which minimizes the generation of air inclusions in the ink, which may lead to contamination and/or malfunction of the printing system at the printing heads.

According to one aspect, the present invention provides an ink storage apparatus for a printing system, comprising at least one ink container defining a storage volume for holding a predetermined volume of printing ink. The ink container is elongated and has a substantially uniform or constant cross-sectional profile perpendicular or normal to a longitudinal axis thereof, wherein the uniform cross-sectional profile is elliptical or oval.

In this regard, it has surprisingly been demonstrated by testing that the mixing or stirring of ink in a container having an elliptical or oval cross-section is significantly more efficient than in a container having a round or circular cross-section. In the conventional circular or round containers, the ink tends to rotate uniformly but with little vertical mixing, though this may be realized or achieved by the design of the mixer device. Containers with a polygonal (e.g. square or rectangular) cross-sectional profile, on the other hand, are particularly unsuitable, as the ink in the corner regions tends to stagnate and is not mixed well. The ink storage apparatus of the invention therefore provides for a more efficient and/or a faster mixing than known reservoirs. In this way, the ink composition, such as a UV gelling ink, which comprises a mix of acrylates and a mix of wax, is able to be mixed more quickly and more effectively in storage in the printer, to re-disperse and maintain the ink components in a well-mixed state for optimum printer performance.

As will be appreciated, the elliptical, or oval cross-section, or cross-sectional profile of the ink container has a major axis and a minor axis. In an embodiment, a ratio of a diameter (internal) of the container on the major axis to a diameter (internal) of the container on the minor axis lies in the range of 3:1 to 1.1:1, and more preferably within the range of 2:1 to 1.2:1.

In view of the above, it will be appreciated that the at least one ink container in the ink storage apparatus of the invention is typically configured to accommodate at least one agitator device, within the storage volume, for agitating and/or mixing the printing ink contained therein. The at least one agitator device will usually be inserted or arranged in the ink container in a direction extending generally parallel to the longitudinal axis of the container. Furthermore, the at least one agitator device is preferably configured to rotate about an axis generally parallel to the longitudinal axis of the container.

In an embodiment of the invention, the at least one ink container defines a storage volume in the range of about 1 liter to about 5 liters, and preferably in the range of about 2 liters to about 3 liters.

In an embodiment, the ink storage apparatus comprises a plurality of said ink containers. The plurality of ink containers are preferably arranged side-by-side such that minor axes of the respective elliptical or oval cross-sectional profiles are substantially aligned with one another. When a plurality of round or circular cross-sectioned conventional ink containers having a 2-3 liter storage capacity or volume are arranged in a row in a conventional ink reservoir or ink supply system, which typically demands 6 bottles to accommodate ink in the three primary colors of cyan, magenta, and yellow, as well as black, white, and varnish, the total size of the arrangement may be overly large to fit within a maximum machine width (door-width) of a current printing system. In this context, also, the elliptical or oval cross-sectional profile of the containers or bottles provides an optimal solution. That is, by arranging the plurality of ink containers side-by-side such that minor axes of the respective elliptical or oval cross-sectional profiles are substantially aligned with one another, the total dimension is reduced and may be accommodated within the available space without redesigning the printing machine.

Thus, in an embodiment, the ink storage apparatus comprises a plurality of the ink containers, especially six ink containers, each of which is designated to hold and/or store one of cyan ink, magenta ink, yellow ink, black ink, white ink, and varnish. A wide format high volume inkjet printer, for example, typically requires six large ink containers or bottles for bulk ink storage (CMYK, white and varnish), but four containers (CMYK) is also conceivable. To this end, a storage volume of 2-3 liters per container or bottle is contemplated for such a printing system.

In an embodiment, the ink storage apparatus further includes an agitator device arranged within the storage volume of each ink container for agitating the ink. The agitator device typically takes the form of a mixing device, and comprises at least one agitator member configured to rotate about an axis generally parallel to the longitudinal axis of the container. In this way, the agitator member may be more precisely considered as a stirrer member. As noted above, the elliptical or oval cross-sectional profile has been found to substantially enhance the effect or performance of the rotatable agitator member or stirrer member. Naturally, also, the specific configuration of the rotatable agitator member plays a significant part in the efficiency and effectiveness or performance of the agitator device or mixing device.

In an embodiment, the agitator member comprises a paddle element having a generally rectangular configuration, and especially a generally open rectangular configuration. In this regard, the rotational axis of the agitator member preferably substantially corresponds with a major axis of the rectangular configuration. Further, the agitator member may include a plurality of fin elements arranged in an open central region of the rectangular paddle element, wherein the fin elements are preferably configured and arranged to extend out of a plane of the rectangular configuration. In this regard, an orientation or position of each of the fin elements in the open central region of the rectangular configuration is desirably adjustable or settable to optimize the stirring performance for a particular printing ink, and/or for a particular container size.

According to another aspect, the invention provides an ink storage apparatus for a printing system, comprising: at least one ink container defining a storage volume for holding a predetermined volume of printing ink, and an agitator device which is arranged within the storage volume of the ink container for agitating the ink held therein. The agitator device comprises at least one agitator member configured to rotate about an axis, and the agitator member preferably includes a plurality of fin elements which are configured or arranged to extend out of a primary plane of the agitator member.

In an embodiment, the agitator member comprises a paddle element, which has a generally flat or planar rectangular shape or configuration. The rotational axis of the agitator member substantially corresponds to a major axis of the rectangular paddle element, and the plurality of fin elements are arranged to extend out of a plane of the paddle element. The paddle element may, for example, have a generally open rectangular configuration, and the plurality of fin elements may be arranged in an open central region of the paddle element. The paddle element generally provides circumferential and/or radial mixing of the ink in a substantially horizontal direction. The fin elements, on the other hand, promote mixing of the ink in an axial direction (e.g. in a vertical direction generally parallel to the rotational axis of the agitator member or paddle element). In this way, both the mixing efficacy and the mixing efficiency can be enhanced by the fin elements.

In an embodiment, an orientation and/or a position of each of the fin elements is adjustable or settable. In this way, it is possible to optimize the mixing or stirring performance of the agitator member for a particular printing ink and/or for a particular container. In particular, the position of each fin element can, for example, be adjusted depending upon the type of ink held in the container (e.g. the rheological behavior of the ink) and/or depending upon the size and/or shape of the ink container.

As noted above, the at least one ink container is typically elongate or tall with a generally uniform cross-sectional profile perpendicular or normal to a longitudinal axis thereof. Thus, the agitator member is therefore preferably configured to rotate about an axis essentially parallel to the longitudinal axis of the container.

According to a further aspect, the present invention provides a printing system, comprising an ink storage apparatus according to any one of the embodiments described above. Each container of the ink storage apparatus should be readily accessible for refilling (e.g. by an operator of the printing system) and for service-actions (e.g. by a maintenance technician).

According to yet another aspect, the invention provides use of an agitator device in an ink storage apparatus, comprising at least one ink container defining a storage volume holding a predetermined volume of printing ink. The ink container is tall or elongate, and has an elliptical or oval cross-sectional profile taken perpendicular or normal to a longitudinal axis of the container. As noted above, the agitator device preferably rotates about an axis substantially parallel to the longitudinal axis of the container.

BRIEF DESCRIPTION OF THE DRAWINGS

For a more complete understanding of the invention, and the advantages thereof, exemplary embodiments of the invention are explained in more detail in the following description, with reference to the accompanying drawing figures, in which like reference characters designate like parts and in which.

The accompanying drawings are included to provide a further understanding of the present invention and are incorporated in and constitute a part of this specification. The drawings illustrate particular embodiments of the invention and together with the description serve to explain the principles of the invention. Other embodiments of the invention, and many of the attendant advantages of the invention, will be readily appreciated as they become better understood with reference to the following detailed description.

It will be appreciated that common and/or well understood elements that may be useful or necessary in a commercially feasible embodiment, which are not necessarily depicted, in order to facilitate a more abstracted view of the embodiments. The elements of the drawings are not necessarily illustrated to scale relative to each other. It will further be appreciated that certain actions and/or steps in an embodiment of a method may be described or depicted in a particular order of occurrences, while those skilled in the art will understand that such specificity with respect to sequence is not actually required. It will also be understood that the terms and expressions used in the present specification have the ordinary meaning, as is accorded to such terms and expressions with respect to their corresponding respective areas of inquiry and study, except where specific meanings have otherwise been set forth herein.

DETAILED DESCRIPTION OF THE PREFERRED EMBODIMENTS

Figure 1:
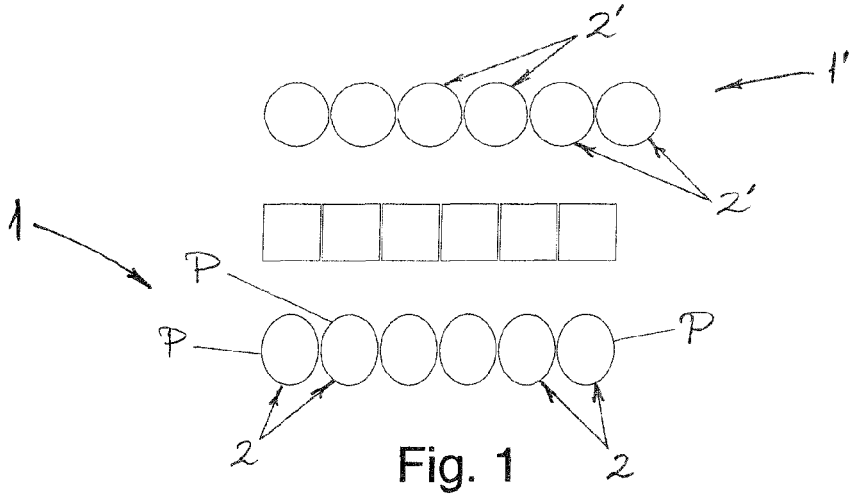
FIG. 1 is a schematic top view of three different ink storage assemblies as a comparison to illustrate an ink storage apparatus for a printing system according to one embodiment of the invention.

With reference firstly to FIG. 1 of the drawings, a schematic comparison of three different ink storage assemblies, illustrates an ink storage apparatus 1 for a printing system according to one embodiment of the invention. In particular, the ink storage apparatus 1 of the invention is illustrated in the lowermost row of six containers 2 shown from above. Each of the containers 2 is substantially identical, and defines a storage volume for holding and/or storing a predetermined volume, e.g. about 2 to 3 liters, of printing ink, and particularly one of cyan ink, magenta ink, yellow ink, black ink, white ink, and varnish.

Thus, each ink container 2 essentially comprises a bottle or flask, which is elongate and has a substantially uniform or constant cross-sectional profile P (as shown), taken perpendicular or normal to a longitudinal axis of the container. As is clearly apparent from the ink storage apparatus 1 shown in the lowermost row in FIG. 1, the uniform cross-sectional profile P of each ink container 2 is elliptical or oval, and the six ink containers 2 are arranged side-by-side such that minor axes of the respective elliptical or oval cross-sectional profiles are substantially aligned with one another. In this way, a significantly more compact array of the containers 2 is achieved for a given storage volume compared with the ink storage apparatus 1' in the uppermost row of containers 2' having a round or circular cross-section. The square-shaped container cross-sections, which are shown schematically in the middle row of FIG. 1 for comparison only, also provide for a compact arrangement. Such containers are entirely unsatisfactory for ink storage, however, as the ink in the corner regions of the containers tends to remain largely uninfluenced by any stirring, which results in an inconsistent and poorer ink quality in the container.

Figure 2:
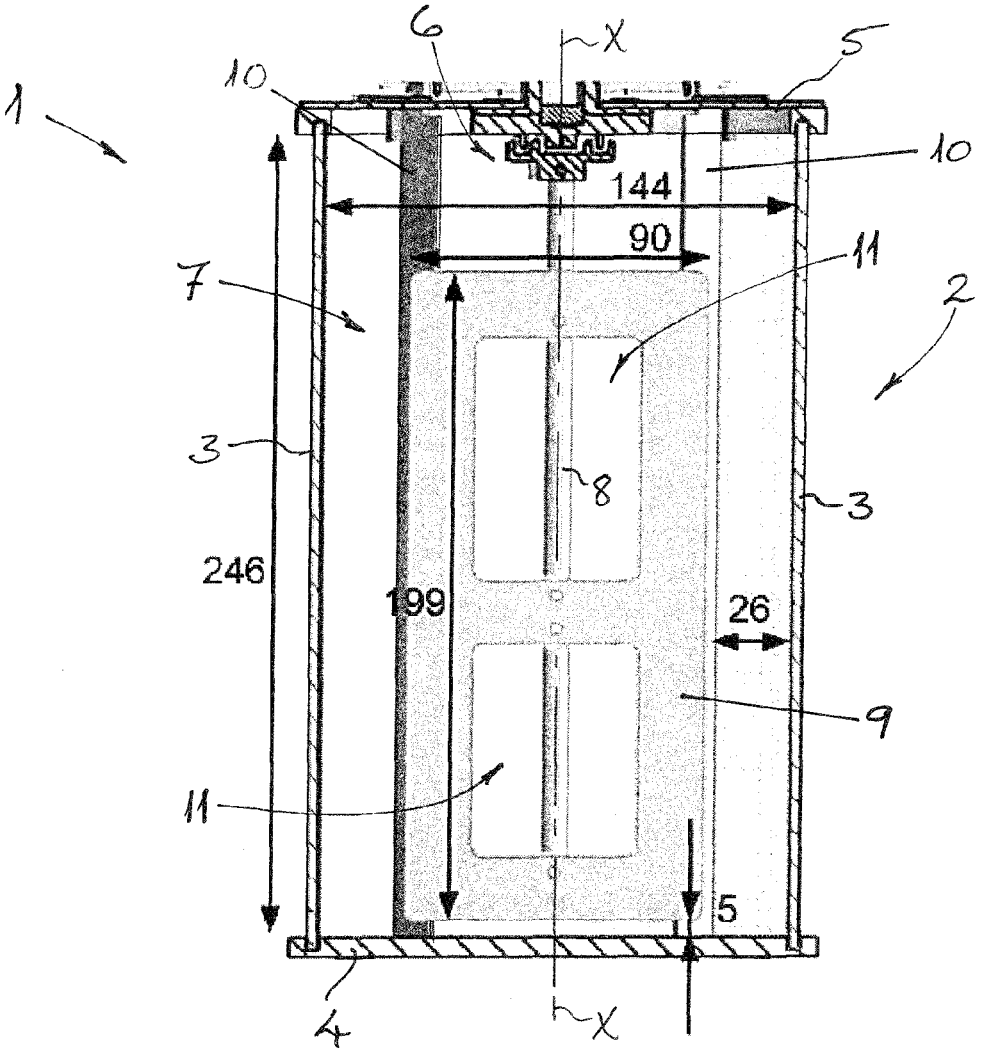
FIG. 2 is a schematic side view of an ink storage apparatus in a printing system according to an embodiment of the invention.

Referring now to FIG. 2 of the drawings, an ink storage apparatus 1 according to an embodiment is illustrated schematically in a partially sectioned side view. For this reason, a single container 2 is shown in a vertical or longitudinal cross-section, with side walls 3, base 4, and a lid 5 of the elliptical cylinder container 2, shown with cross-hatching. The dimensions (given in millimeters) of the ink storage apparatus 1 in this specific example are also provided.

The ink storage apparatus 1, shown in FIG. 2, includes an agitator device 6 located within the storage volume of the ink container 2, for agitating, particularly for mixing or stirring, the printing ink which is held or stored in the container 2. The agitator device 6 comprises an agitator member 7 arranged centrally in the ink container 2, and mounted on a shaft 8 for rotation about an axis that is generally coincident with a central longitudinal axis X of the container 2 for agitating, and thus mixing and stirring, the ink. The agitator member 7 comprises a paddle element 9 having a generally flat open rectangular configuration, and the rotational axis X generally corresponds with a major axis of that rectangular configuration. The shaft 8 and the paddle element 9 are driven in rotation by an electric motor (not shown). Also within the storage volume of the ink container 2, elongate baffle members 10 are arranged extending between the base 4 and the lid or cover 5 of the container 2. The baffle members 10 are static or stationary and present flat, radially extending surfaces positioned beyond a radial extent of the agitator member 7. In this way, the baffle members 10 cooperate with the agitator member 7 to assist mixing of the ink, as the rectangular paddle element 9 rotates about the axis X.

Figure 3:
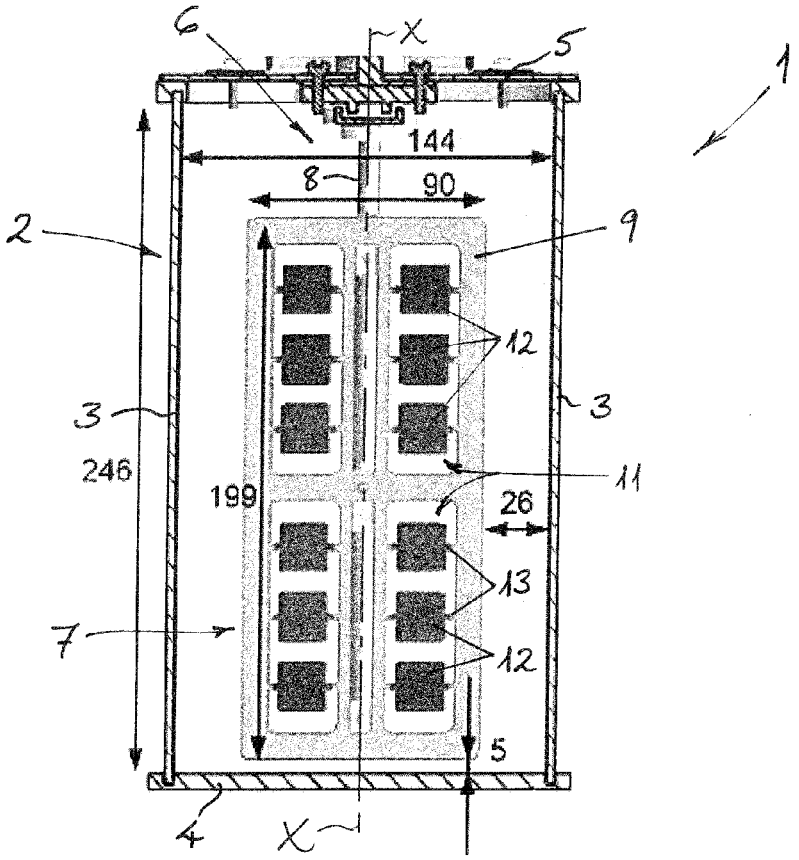
FIG. 3 is a schematic side view of an ink storage apparatus in a printing system according to an embodiment of the invention.

With reference now to FIG. 3 of the drawings, an ink storage apparatus 1 according to another embodiment is shown schematically in a partially sectioned side view. Again in this embodiment, a single container 2 is shown in a vertical or longitudinal cross-section, with the side walls 3, base 4, and lid 5 of the elliptical cylinder container 2 shown with cross-hatching. Dimensions (in millimeter) of the ink storage apparatus 1 in this specific example are again also provided.

The ink storage apparatus 1 shown in FIG. 3 has a very similar configuration to the apparatus 1 described with reference to FIG. 2. In this embodiment, however, there are no baffle members 10 arranged around the rotatable agitator member 7 in the ink container 2, and the agitator member 7 has a more complex configuration. More specifically, the agitator member 7 of the agitator device 6 again comprises a paddle element 9 having a generally flat open rectangular configuration. In an open central region 11 of the paddle element 9 in this case, however, a plurality of fin elements 12 are provided. Each fin element 12 comprises a generally flat plate element, which is mounted and supported on transverse pin members 13 fixed to the paddle element 9.

Figure 4A:
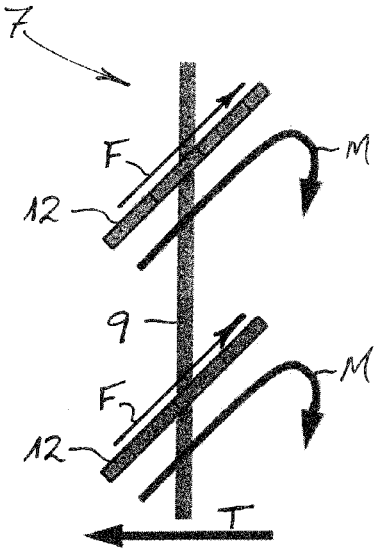
FIG. 4*a* is a detailed side view of part of the agitator device in the ink storage apparatus shown in FIG. 3.
Figure 4B:
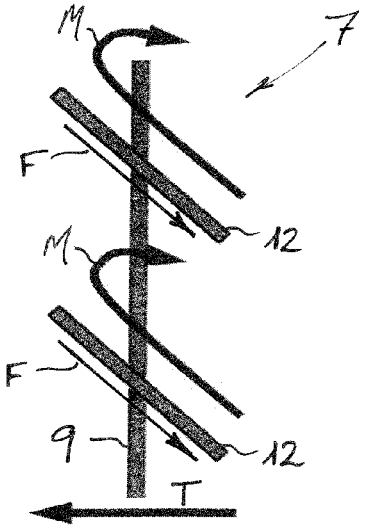
FIG. 4*b* is a detailed side view of another part of the agitator device in the ink storage apparatus shown in FIG. 3.

As is apparent from the cross-sectional views in FIG. 4*a* and FIG. 4*b*, each of the fin elements 12 is configured or arranged to extend out of a plane of the rectangular paddle element 9. In this regard, the orientation or position of each fin element 12, shown in FIG. 4*a*, corresponds to the vertical row of fin elements 12 on the left-hand side of the agitator member 7 in FIG. 3, and the orientation or position of each fin element 12, shown in FIG. 4*b*, corresponds to the vertical row of fin elements 12 on the right-hand side of the agitator member 7 in FIG. 3. The arrow T represents the instantaneous (tangential) direction of travel of the agitator member 7 as it rotates, and the arrows F represent the direction of flow imparted to the liquid ink by the fin elements 12, as the agitator device 6 operates. In this regard, it will be noted that the fin elements 12 in the open region 11 of the paddle element 9 act to push the liquid ink in an axial or vertical direction (i.e. upwards in FIG. 4*a* and downwards in FIG. 4*b*). Due to this movement of the ink, the pressure behind each fin element 12 decreases such that suspended particles in the ink and eddy currents generated in the liquid move or swirl in the directions of arrows M indicated. It will be noted that the orientation or position of each of the fin elements 12 may be adjusted or set on the transverse pin members 13, to optimize the stirring performance for a particular printing ink and/or for a particular ink container 2.

With the above embodiments of the present invention, therefore, a more efficient and more effective ink storage apparatus is provided. In this way, a reduced or minimum rotation speed is possible with the agitator device 6 while still achieving and maintaining a well-mixed printing ink in the ink container 2. This results in reduced energy consumption, allowing use of a small driving motor, and reduced mechanical work and heat load on the ink, thereby reducing the need for extra cooling of the ink storage, and having superior mixing quality substantially without vortex generation.

Although specific embodiments of the invention are illustrated and described herein, it will be appreciated by those of ordinary skill in the art that a variety of alternate and/or equivalent implementations exist. It should be appreciated that the exemplary embodiment or exemplary embodiments are examples only, and are not intended to limit the scope, applicability, or configuration in any way. Rather, the foregoing summary and detailed description will provide those skilled in the art with a convenient road map for implementing at least one exemplary embodiment, it being understood that various changes may be made in the function and arrangement of elements described in an exemplary embodiment without departing from the scope as set forth in the appended claims and their legal equivalents. Generally, this application is intended to cover any adaptations or variations of the specific embodiments discussed herein.

It will also be appreciated that in this document the terms "comprise," "comprising," "include," "including," "contain," "containing," "have," "having," and any variations thereof, are intended to be understood in an inclusive (i.e. non-exclusive) sense, such that the process, method, device, apparatus or system described herein is not limited to those features or parts or elements or steps recited but may include other elements, features, parts or steps not expressly listed or inherent to such process, method, article, or apparatus. Furthermore, the terms "a" and "an" used herein are intended to be understood as meaning one or more, unless explicitly stated otherwise. Moreover, the terms "first," "second," "third," etc., are used merely as labels, and are not intended to impose numerical requirements on or to establish a certain ranking of importance of their objects.

LIST OF REFERENCE SIGNS

1 apparatus
2 ink container
3 side wall of ink container
4 base of ink container
5 lid or cover of ink container
6 agitator device
7 agitator member
8 shaft
9 paddle element
10 baffle member
11 open central region
12 fin element
13 pin element
P cross-sectional profile
X longitudinal axis of container
T direction of travel of agitator member
F direction of flow of ink
M particle mixing movement within ink

What is claimed is:

1. An agitator device for an ink storage apparatus in a printing system, comprising:

at least one agitator member which is configured to rotate about an axis, wherein the agitator member includes a plurality of fin elements which are mounted and supported on transverse pin members fixed in a primary plane of the agitator member, and wherein said fin elements are configured or arranged to extend out of the primary plane of the agitator member.

2. The agitator device according to claim 1, wherein the agitator member comprises a paddle element having a generally planar rectangular configuration, wherein the rotational axis of the agitator member substantially corresponds to a major axis of the rectangular paddle element, and wherein the plurality of fin elements are arranged to extend out of a plane of the paddle element.

3. The agitator device according to claim 2, wherein the paddle element has a generally open rectangular configuration, and wherein the plurality of fin elements are arranged in an open central region of the paddle element.

4. An ink storage apparatus for a printing system, comprising:

at least one ink container defining a storage volume for holding a predetermined volume of printing ink; and an agitator device arranged within the storage volume of the ink container for agitating the ink, wherein the agitator device comprises at least one agitator member which is configured to rotate about an axis, wherein the agitator member includes a plurality of fin elements which are mounted and supported on transverse pin members fixed in a primary plane of the agitator member, and wherein said fin elements are configured or arranged to extend out of the primary plane of the agitator member.

5. The ink storage apparatus according to claim 4, wherein the ink container is elongated with a substantially uniform cross-sectional profile (P) in a direction perpendicular to a longitudinal axis (X) thereof, and wherein the agitator member is configured to rotate about an axis generally parallel to the longitudinal axis (X) of the container.

6. The ink storage apparatus according to claim 4, wherein an orientation or position of each of the fin elements in the agitator member is adjustable or settable to optimize performance for a particular printing ink and/or for a particular container.

7. The ink storage apparatus according to claim 4, wherein the at least one ink container is elongate and has a substantially uniform cross-sectional profile (P) perpendicular to a longitudinal axis (X) thereof, and wherein the cross-sectional profile (P) is elliptical or oval.

8. The ink storage apparatus according to claim 7, wherein the at least one ink container comprises a plurality of ink containers which are arranged side-by-side such that minor axes of the respective elliptical or oval cross-sectional profiles (P) are substantially aligned with one another.

9. The ink storage apparatus according to claim 4, wherein the at least one ink container comprises a plurality of ink containers.

10. The ink storage apparatus according to claim 9, wherein the plurality of ink containers comprises six containers, each of which is designated for one of cyan ink, magenta ink, yellow ink, black ink, white ink, and varnish.

11. The ink storage apparatus according to claim 4, wherein each ink container defines a storage volume in the range of about 1 liter to about 5 liters.

12. The ink storage apparatus according to claim 4, wherein the agitator device comprises at least one agitator member configured to rotate about an axis generally parallel to the longitudinal axis (X) of the container.

13. The ink storage apparatus according to claim 12, wherein the agitator member comprises a paddle element having a generally rectangular configuration, and wherein a rotational axis of the agitator member substantially corresponds with a major axis of the rectangular configuration.

14. The ink storage apparatus according to claim 13, wherein the agitator member includes a plurality of fin elements arranged in an open central region of the paddle element, wherein the fin elements are configured or arranged to extend out of a plane of the rectangular configuration, and wherein an orientation or position of each of the fin elements in the open central region is adjustable or settable to optimize the stirring performance for a particular printing ink and/or for the container.

15. The ink storage apparatus according to claim 13, wherein the paddle element has a generally open rectangular configuration.

16. A printing system comprising the ink storage apparatus according to claim 4.

17. The ink storage apparatus according to claim 4, wherein each ink container defines a storage volume in the range of about 2 liters to 3 liters.

18. An agitator device for in an ink storage apparatus, comprising at least one ink container defining a storage volume for holding a predetermined volume of printing ink, wherein the agitator device comprises at least one agitator member which is configured to rotate about an axis, wherein the agitator member includes a plurality of fin elements which are mounted and supported on transverse pin members fixed in a primary plane of the agitator member, and wherein said fin elements are configured or arranged to extend out of the primary plane of the agitator member.

* * * * *